US008333143B2

(12) United States Patent
Liao

(10) Patent No.: US 8,333,143 B2
(45) Date of Patent: Dec. 18, 2012

(54) HYDRAULIC CYLINDER DEVICE

(76) Inventor: Yu-Hui Liao, Taichung County (TW)

( * ) Notice: Subject to any disclaimer, the term of this patent is extended or adjusted under 35 U.S.C. 154(b) by 771 days.

(21) Appl. No.: 12/462,229

(22) Filed: Jul. 31, 2009

(65) Prior Publication Data

US 2011/0023707 A1 Feb. 3, 2011

(51) Int. Cl.
*F01C 9/00* (2006.01)

(52) U.S. Cl. ..... 92/124; 92/125; 92/121; 464/25

(58) Field of Classification Search ..... 92/124, 92/126, 60, 120, 121, 122, 123, 125, 169.1; 277/357, 589; 464/25, 34, 37; 173/93.5; 418/147, 148
See application file for complete search history.

(56) References Cited

U.S. PATENT DOCUMENTS 4,462,771 A * 7/1984 Teegarden ..... 277/379
4,767,379 A * 8/1988 Schoeps ..... 464/25
4,789,373 A * 12/1988 Adman ..... 464/25
4,854,916 A * 8/1989 Schoeps et al. ..... 464/25
4,967,852 A * 11/1990 Tatsuno ..... 173/93
6,110,045 A * 8/2000 Schoeps ..... 464/25
6,607,197 B2 * 8/2003 Baehl et al. ..... 277/553

* cited by examiner

*Primary Examiner* — Edward Look
*Assistant Examiner* — Logan Kraft
(74) *Attorney, Agent, or Firm* — Charles E. Baxley

(57) ABSTRACT

A hydraulic cylinder device includes a cylinder, an axle and two blade units. The cylinder includes a chamber with a cross-sectional shape like a circle overlapping another circle. The axle is inserted through the cylinder. The axle includes two opposite grooves defined therein. Each of blade units includes a blade, a primary roller and a secondary roller. The blade is movably disposed in a related one of the grooves and made with a groove defined in a side close to an internal side of the cylinder. The secondary roller is disposed in the groove. The primary roller is disposed in the groove so that the primary roller is in contact with the secondary roller on one hand and in contact with the cylinder on the other hand.

5 Claims, 5 Drawing Sheets

HYDRAULIC CYLINDER DEVICE

BACKGROUND OF INVENTION

1. Field of Invention

The present invention relates to a hydraulic torque impulse generator, and more particularly, to a low-friction, efficient, and durable hydraulic torque impulse generator.

2. Related Prior Art

A pneumatic power wrench is often equipped with a hydraulic torque impulse generator for transmitting power, such as torque for fastening or slacking nuts or screws. The efficiency of the hydraulic torque impulse generator is critical for the efficiency of the pneumatic power wrench.

A hydraulic torque impulse generator generally includes a cylinder, an axle inserted through the cylinder, blades non-rotational but movable relative to the axle, and springs for achieving the movement of the blades relative to the axle. To achieve high efficiency, suppress vibration, and reduce noise, the cylinder includes a chamber with a cross-sectional shape that looks like a circle overlapping another circle. Thus, the chamber includes a waist portion. Friction between each of the blades and the wall of the chamber reaches a maximum when the blade moves past the waist portion of the chamber. The maximum friction reduces the speed of rotation of the axle, thus reducing the power of the hydraulic torque impulse generator. Moreover, the maximum friction between the blades and the cylinder would wear out the blades or cylinder soon so that the blades or the cylinder would have to be replaced soon.

The present invention is therefore intended to obviate or at least alleviate the problems encountered in prior art.

SUMMARY OF INVENTION

It is the primary objective of the present invention to provide a low-friction, efficient, and durable hydraulic torque impulse generator.

To achieve the foregoing objective, the hydraulic torque impulse generator includes a cylinder, an axle, and two blade units. The cylinder includes a chamber with a cross-sectional shape like a circle overlapping another circle. The axle is inserted through the cylinder. The axle includes two opposite grooves defined therein. Each of blade units includes a blade, a primary roller, and a secondary roller. The blade is movably disposed in a related one of the grooves and made with a groove defined in a side close to an internal side of the cylinder. The secondary roller is disposed in the groove. The primary roller is disposed in the groove so that the primary roller is in contact with the secondary roller on one hand and in contact with the cylinder on the other hand.

Other objectives, advantages and features of the present invention will be apparent from the following description referring to the drawings.

BRIEF DESCRIPTION OF DRAWINGS

The present invention will be described via detailed illustration of two embodiments referring to the drawings.

DETAILED DESCRIPTION OF EMBODIMENTS

Figure 1:
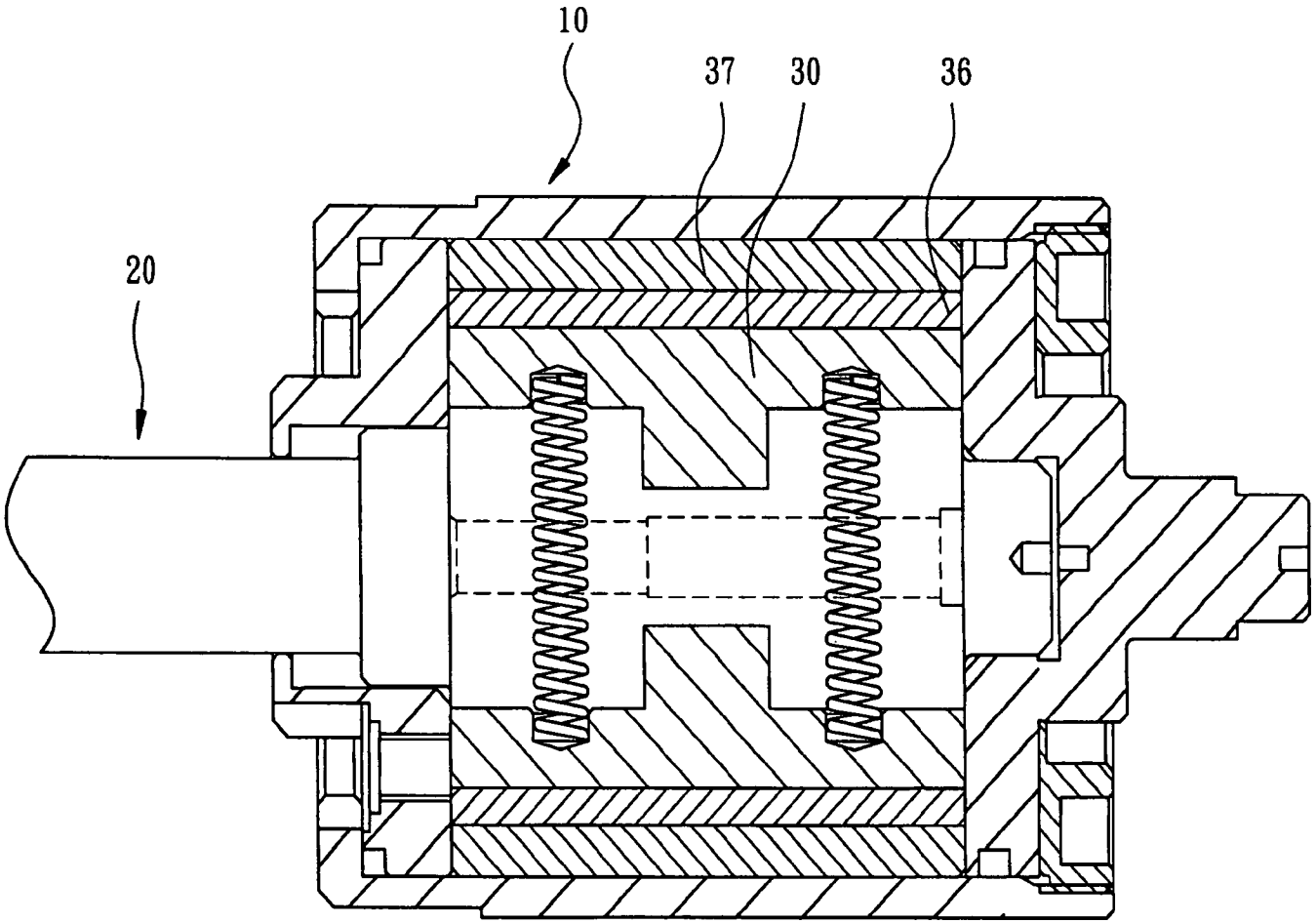
FIG. 1 is a cross-sectional view of a hydraulic torque impulse generator according to the first embodiment of the present invention.
Figure 2:
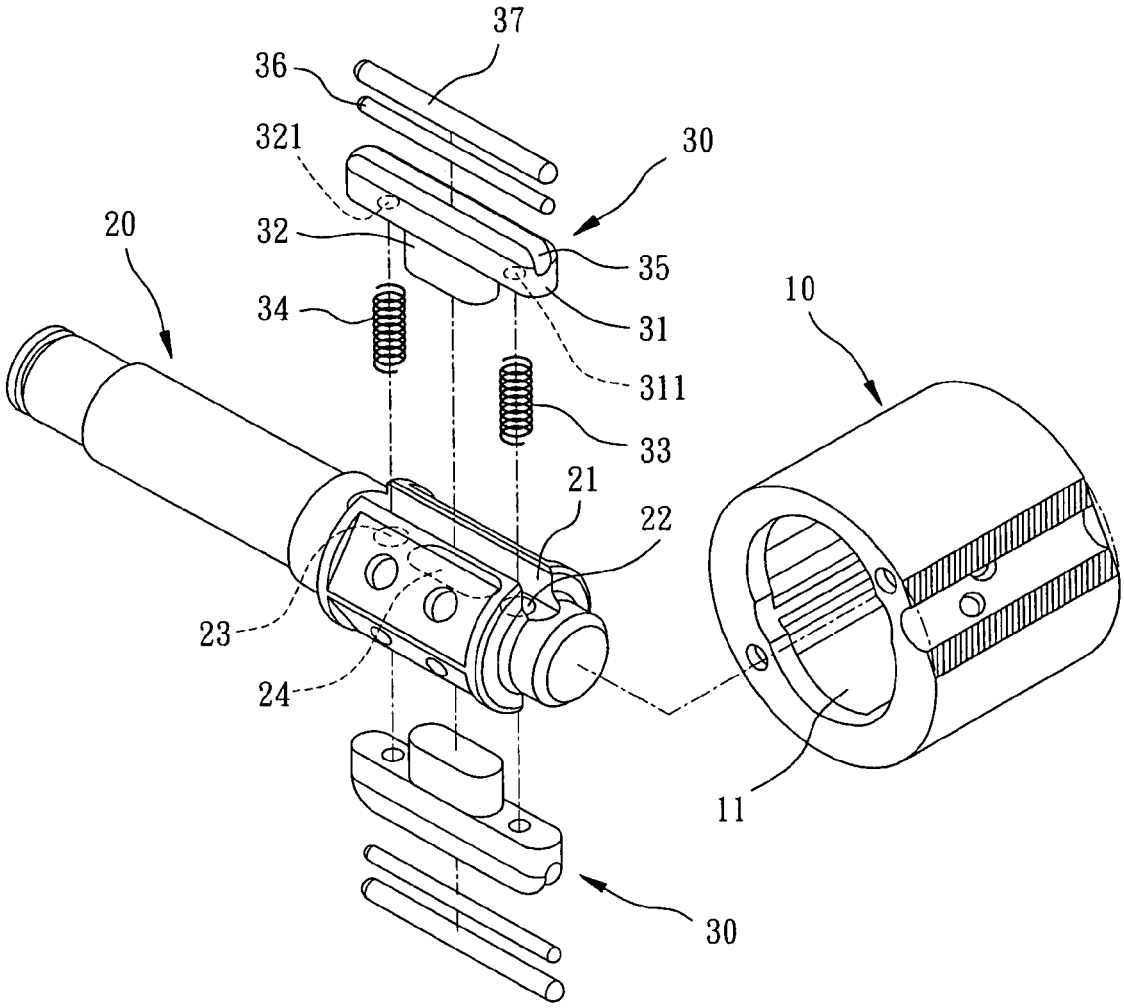
FIG. 2 is an exploded view of the hydraulic torque impulse generator shown in FIG. 1.

Referring to FIGS. 1 and 2, there is shown a hydraulic torque impulse generator according to a first embodiment of the present invention. The hydraulic torque impulse generator includes a cylinder 10, an axle 20 inserted through the cylinder 10, two blade units 30 non-rotational but movable relative to the axle 20, and two springs 33 and 34 for achieving the movement of the blade units 30 relative to the axle 20.

The axle 20 includes two opposite longitudinal grooves 21 defined therein and two transverse tunnels 22 and 23 for communicating the grooves 21 with each other. A shorter groove 24 is defined in the floor of each of the grooves 21.

Each of the blade units 30 includes a blade 31 and two rollers 36 and 37. The blade 31 includes a rib 32 formed on a side thereof, two recesses 311 and 321 defined in the side and a groove 35 defined in an opposite side. The groove 35 includes two plain walls parallel to each other and a hemi-cylindrical floor between the plain walls. The rib 32 is located between the recesses 311 and 321. The rib 32 is movably inserted in a related one of the grooves 24 when the blade 31 is movably inserted in a related one of the groove 21. The rollers 36 and 37 are rotationally disposed in the groove 35. Thus, the roller 36 is located between the floor of the groove 35 and the roller 37, and the roller 37 is located between the roller 36 and the wall of the chamber 11.

The springs 33 and 34 are inserted through the tunnels 22 and 23. The spring 33 includes two ends each inserted in the recess 311 of the blade 31 of a related one of the blade units 30. The spring 34 includes two ends each inserted in the recess 321 of the blade 31 of a related one of the blade units 30.

Figure 4:
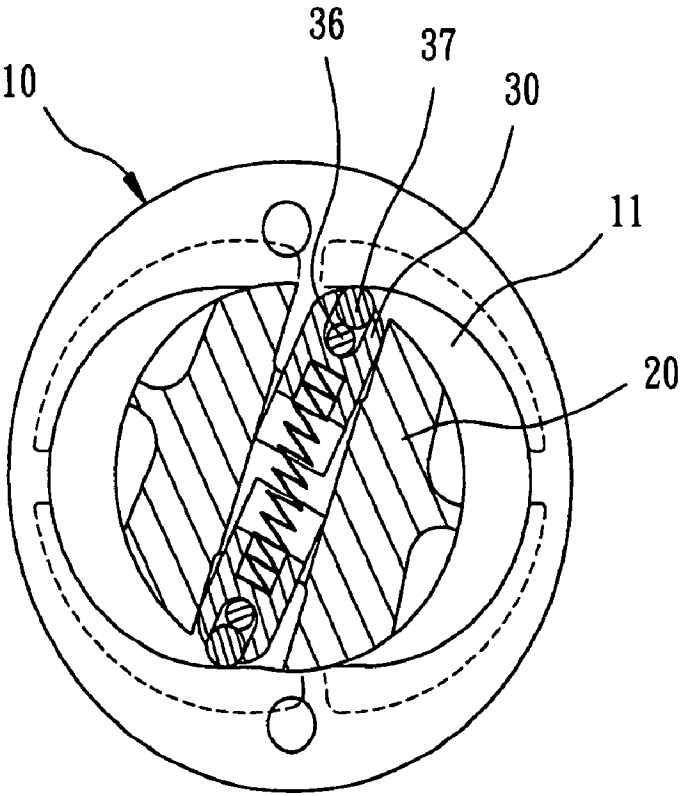
FIG. 4 is a cross-sectional view of the hydraulic torque impulse generator in another position than shown in FIG. 3.
Figure 3:
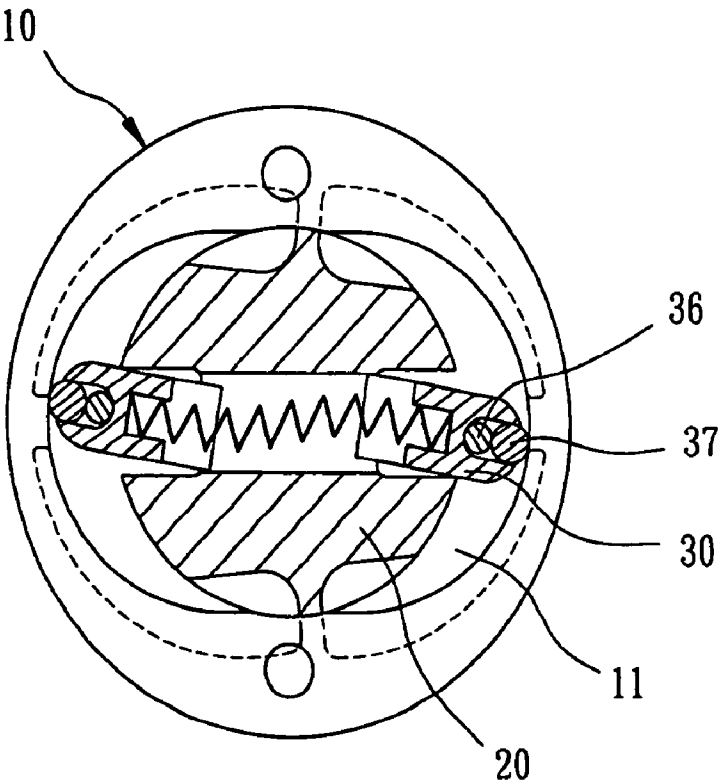
FIG. 3 is another cross-sectional view of the hydraulic torque impulse generator shown in FIG. 1.

Referring to FIGS. 3 and 4, to achieve a high efficiency, suppress vibration and reduce noise, the cylinder 10 includes a chamber 11 with a cross-sectional shape that looks like a circle overlapping another circle. Thus, the chamber 11 includes a waist portion. Friction between each of the blade units 30 and the wall of the chamber 11 reaches a maximum when the blade unit 30 moves past the waist portion of the chamber 11. Advantageously, the maximum of friction between the blade units 30 and the wall of the chamber 11 is small because the rollers 37 roll on the wall of the chamber 11.

Figure 6:
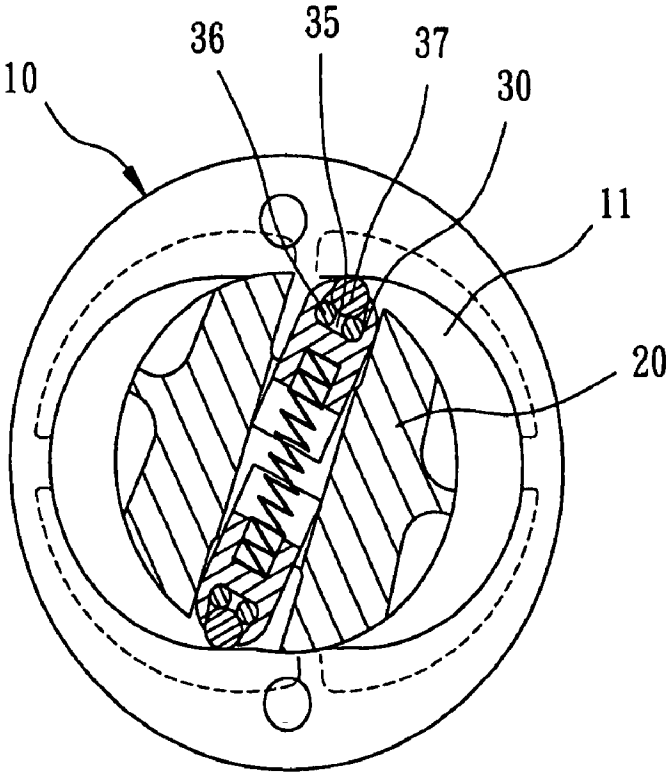
FIG. 6 is a cross-sectional view of the hydraulic torque impulse generator in another position than shown in FIG. 5.
Figure 5:
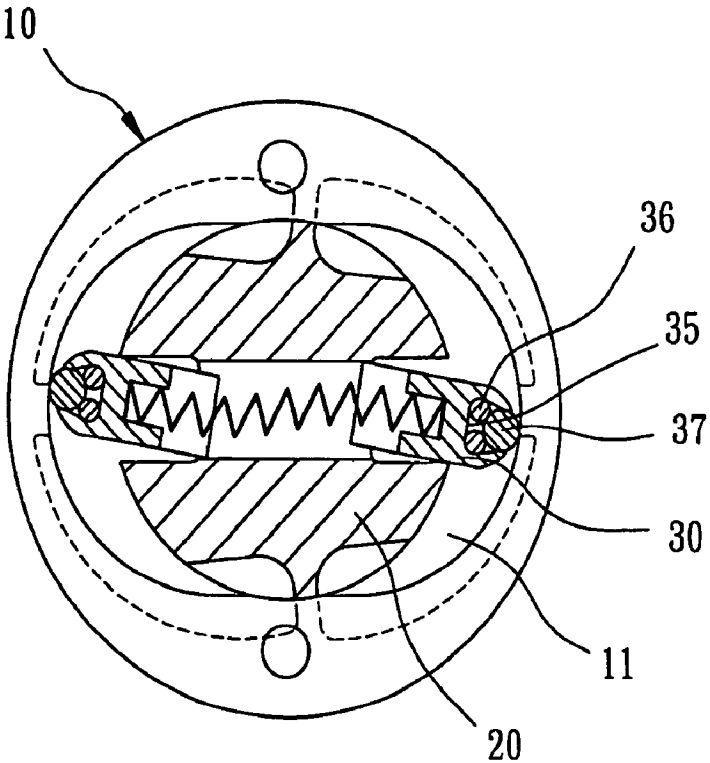
FIG. 5 is a cross-sectional view of a hydraulic torque impulse generator according to the second embodiment of the present invention.

Referring to FIGS. 5 and 6, there is shown a hydraulic torque impulse generator according to a second embodiment of the present invention. The second embodiment is like the first embodiment except two things. Firstly, each of the blade units 30 includes two rollers 36 and a roller 37. Secondly, the groove 35 is a dovetail groove. Each of the rollers 36 is located between the floor of the groove 35 and the roller 37, while the roller 37 is located between each of the rollers 36 and the wall of the chamber 11. The second embodiment supports the roller 37 better than the first embodiment does; without considerably increasing the friction although there are seven lines of contact in the second embodiment while there are only five lines of contact in the first embodiment.

Figure 7:
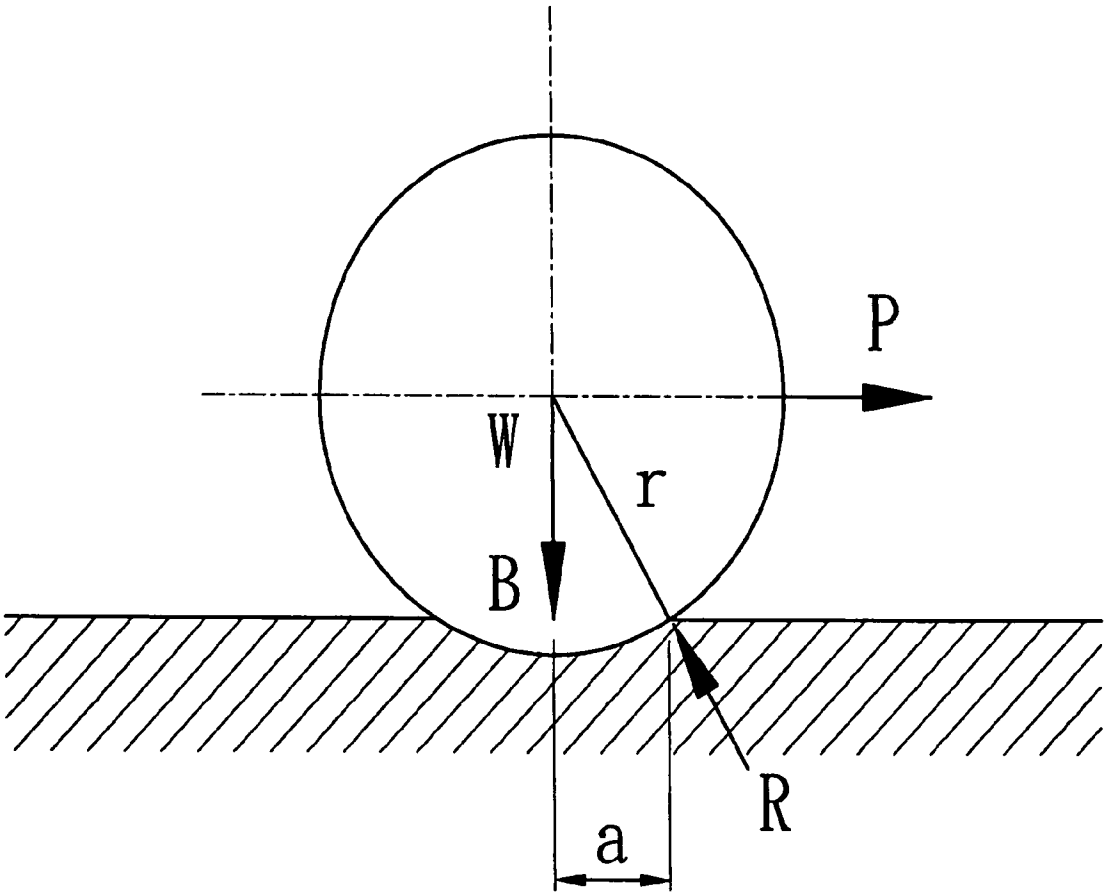
FIG. 7 is a free-body diagram for illustrating physical basics related to the hydraulic torque impulse generator shown in FIG. 1 or 5.

Referring to FIG. 7, when a ball or cylinder rolls on a plain surface, the ball or cylinder dents the originally plain surface, thus producing rolling friction. The rolling friction is larger as the dent is deeper. The relation between the weight W of the ball or cylinder, the friction f and a force P for rolling the ball or cylinder on the originally plain surface is governed with an equation as follows:

$$P=f=W\times a/r;$$

wherein a is the rolling frictional coefficient while r is the radius of the ball or cylinder because $\Sigma M_A=0$ and $OB\approx r$.

The rollers 36 and 37 are light in weight and can hardly dent the wall of the chamber 11. Hence, the friction between the wall of the chamber 11 and each of the blade units 30 is small, almost none. Therefore, the hydraulic torque impulse generator is efficient and durable.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. A hydraulic torque impulse generator, comprising:

a cylinder comprising a chamber with a cross-sectional shape like a circle overlapping another circle;

an axle inserted through the cylinder, wherein the axle comprises two opposite grooves defined therein; and two blades, each comprising:

a blade movably disposed in a related one of the grooves and made with a groove defined in a side close to an internal side of the cylinder;

at least one secondary roller disposed in the groove; and a primary roller disposed in the groove so that the primary roller is in contact with the secondary roller on one hand and in contact with the cylinder on the other hand.

2. The hydraulic torque impulse generator according to claim 1, wherein the groove comprises two plain walls parallel to each other and a hemi-cylindrical floor between the plain walls, and the primary roller is in contact with both of the plain walls.

3. The hydraulic torque impulse generator according to claim 1, wherein each of the blade units comprises two secondary rollers, and the groove is a dovetail groove for receiving both of the secondary rollers and a portion of the primary roller.

4. The hydraulic torque impulse generator according to claim 1 comprising two springs, wherein the axle comprises two tunnels defined therein for communicating the grooves with each other, and each of the springs is inserted through a related one of the tunnels and formed with two ends each connected to the blade of a related one of the blade units.

5. The hydraulic torque impulse generator according to claim 4, wherein the blade of each of the blade units comprises two recesses each for receiving an end of a related one of the springs.

* * * * *